United States Patent [19]

Sasaki

[11] 4,343,234

[45] Aug. 10, 1982

[54] PRESSURE-FIXATION APPARATUS

[75] Inventor: Yoshitaka Sasaki, Kumagaya, Japan

[73] Assignee: Hitachi Metals, Ltd., Japan

[21] Appl. No.: 26,210

[22] Filed: Apr. 2, 1979

[30] Foreign Application Priority Data

Mar. 31, 1978 [JP] Japan ..... 53/37925
Jun. 26, 1978 [JP] Japan ..... 53/77303

[51] Int. Cl.[3] ..... G03G 15/20
[52] U.S. Cl. ..... 100/158 R; 118/116
[58] Field of Search ..... 118/116, 117; 427/361; 430/98, 99; 355/3 FU; 100/158 R, 158 C

[56] References Cited

U.S. PATENT DOCUMENTS 3,272,643 9/1966 Pasek et al. ..... 427/361 X
3,647,525 3/1972 Dahlgren ..... 118/262 X
3,653,320 4/1972 Oehlmann et al. ..... 100/158 R
3,990,391 11/1976 Singh ..... 118/116
4,022,122 5/1977 Moser et al. ..... 100/158 R
4,104,963 8/1978 Fortmann ..... 100/176
4,192,229 3/1980 Tsunoi et al. ..... 100/158 R
4,235,166 11/1980 Tsunoi ..... 100/158 R

FOREIGN PATENT DOCUMENTS 2607271 4/1977 Fed. Rep. of Germany ... 355/3 FU

*Primary Examiner*—John P. McIntosh
*Attorney, Agent, or Firm*—Finnegan, Henderson, Farabow, Garrett & Dunner

[57] ABSTRACT

A device for fixing a toner image to a carrier sheet by pressure, comprising a pair of side frame members cooperating with a base frame member, a top roll and a bottom roll forming a pair of pinch rolls, rotatably mounted on said pair of side frame members and arranged in rolling engagement with each other to provide a nip through which a carrier sheet with a deposit of toner particles thereon is passed to fix the toner particles to the carrier sheet, and a backup roll disposed in rolling engagement with said bottom roll, wherein the axis of the bottom roll extends at an angle within a range from 10′ to 1°30′ relative to the axis of the top roll.

7 Claims, 3 Drawing Figures

PRESSURE-FIXATION APPARATUS

BACKGROUND OF THE INVENTION

The present invention relates to toner image pressure-fixation apparatus in general, and particularly to pressure-fixation apparatus including a pair of pinch rolls and a backup roll wherein at least the pair of pinch rolls is positioned with the axes of the rolls at an angle to each other.

In pressure-fixation apparatus for fixing a dry, pressure-fusible toner image onto a paper, it is known to use a pair of pinch rolls biased toward each other and disposed such that the axis of one roll extends at an angle relative to the axis of the other, so that any irregularity of the nip may be eliminated even when copying paper passes between these rolls.

However, when the cross angle is too large, the copying paper develops creases or wrinkles. In order to avoid such wrinkles in the copying paper, the cross angle must be kept small. When the cross angle is quite small, however, the rolls have to have large diameters to prevent a non-uniform nip by the bending of the rolls. However, if the rolls have larger diameters, not only the pressure-fixation apparatus weighs more but the loading pressure must be increased. This requires a larger pressure mechanism and a higher compression-resistant strength of the bearings of such rolls, attendant increase in strength of bearings, housing, etc., involving heavier weight and higher cost of manufacture.

In order to eliminate these difficulties, pressure-fixation apparatus including a so-called "three-roll system" has been previously proposed. In this system, a top roll and a bottom roll of a pair of pinch rolls are disposed parallel and horizontal without a cross angle between them and, in addition, a backup roll is disposed in a crossing contact relation to the bottom roll. The backup roll is biased resiliently upwards toward the bottom roll of the pair of pinch rolls by a pressure mechanism, while the bottom roll is butted against the top roll under pressure to form a nip along their contacting line through which a copy paper passes. As a flection of the bottom roll can be adjusted by the cross angle of the backup roll relative to the bottom roll, each of the bottom and the backup rolls may have a smaller diameter than the top roll and copying paper may be free from creases because of parallelism of the top roll with the bottom roll.

However, the three-roll system has the drawback of the offset phenomenon, i.e., toner having formed a toner image on a copying paper adheres to some extent onto the contacting roll at the time of pressure-fixing, and then this adhered toner returns onto the copying paper because or rotation of the roll, so as to degrade the resulting image.

SUMMARY OF THE INVENTION

The present invention has an object of eliminating the above-mentioned drawbacks and preventing the offset phenomenon and obtaining a high-quality picture in a pressure-fixation apparatus utilizing the three-roll system.

Another object of the present invention is to provide a pressure-fixation apparatus having means for rotatably receiving a thrust load on the bearing zone of the bottom roll of a pair of pinch rolls in a three-roll system.

According to the present invention, there is provided a device for fixing a toner image to a carrier sheet by pressure, comprising a pair of side frame members cooperating with a base frame member, a pair of pinch rolls mounted on the pair of side frame members, and a backup roll disposed in rolling engagement with the bottom roll of the pair of pinch rolls, wherein the axis of the bottom roll extends at an slight angle relative to the axis of the top roll of the pair of pinch rolls.

DETAILED DESCRIPTION OF THE PREFERRED EMBODIMENT

Figure 1:
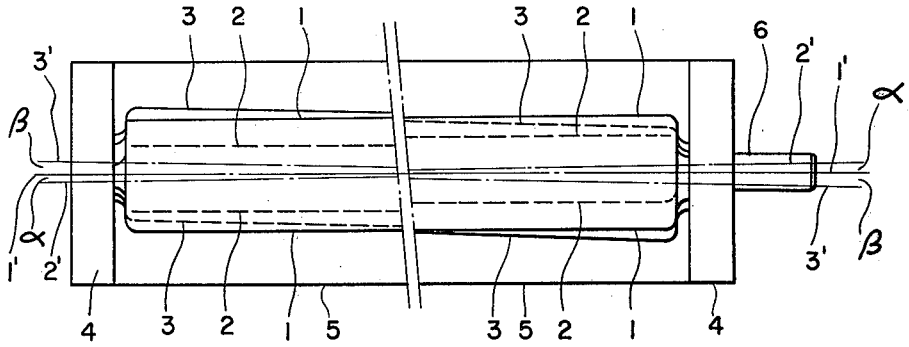
FIG. 1 is a plan view of an embodiment showing the pressure-fixation apparatus of the present invention.
Figure 2:
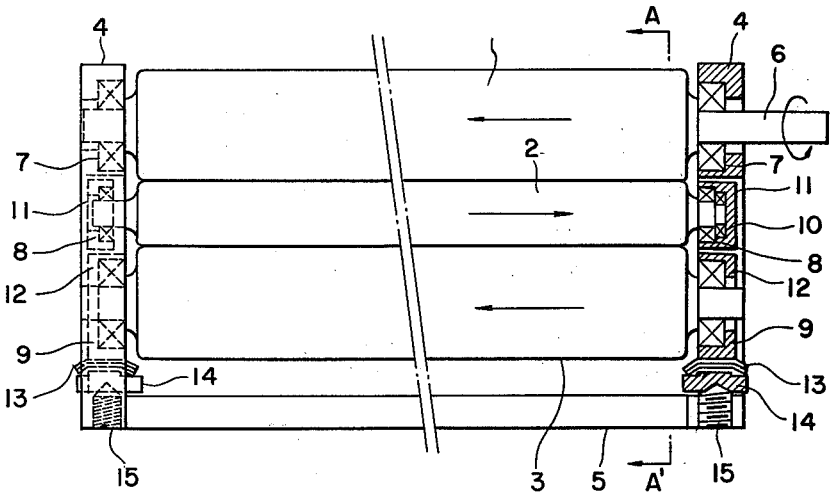
FIG. 2 is a side view of the embodiment shown in FIG. 1.
Figure 3:
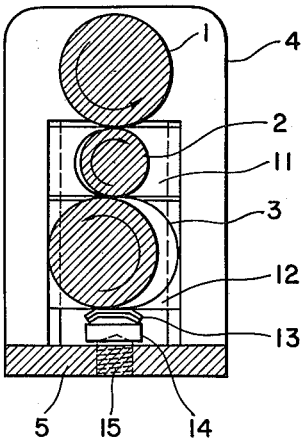
FIG. 3 shows a cross-sectional view taken along a line 3—3 in FIG. 2.

Referring to FIGS. 1–3 showing a pressure-fixation apparatus of the present invention, a top roll 1 of a pair of pinch rolls is rotatably mounted through needle bearings 7 to to a pair of upstanding housing frame members 4 mounted on a base 5. In addition, needle bearings 8 and journals of a bottom roll 2 of the pair of pinch rolls are supported by thrust bearings 10 engaged to guide cleats 11 mounted in channels in the housing members 4, so that the bottom roll 2 is vertically slidable in the housing 4. The bottom roll 2 is disposed in a cross position relative to the top roll 1 with a slight angle $\alpha$, as represented in FIG. 1.

A backup roll is supported through needle bearings 9 by guide cleats 12, similar to the supports of the bottom roll 2, so as to move vertically. This backup roll 3 may be disposed in a cross position to bottom roll 2. Flat springs 13 are mounted below guide cleats 12 which support the backup roll 3. These flat springs 13 are pushed by pressure bolts 15 through spring shoes 14 whose thrust may be adjusted to correspond to a required pressure by controlling the bolts 15.

As described above, the guide cleats 12 are pushed by the flat springs 13 so that the backup roll 3 pushes the bottom roll 2 and butts the bottom roll 2 against the top roll 1 to form a nip. The compensation for the flection or bending of bottom roll 2 resulting from a copying paper passing through the nip between the top roll 1 and the bottom roll 2 is assured by disposing the backup roll 3 at an angle to the bottom roll 2. In the present example, the cross angle of the backup roll 3 is represented as opposite to that of the bottom roll 2 relative to the top roll 1. The cross angle of the backup roll 3 with the top roll 1 is represented as angle $\beta$, as shown in FIG. 1.

The cross angle $\beta$ can be relatively small as compared with the cross angle of the backup roll with the pinch rolls in the conventional three-roll system. This fact is advantageous since it entails easier support mechanism for the backup roll 3.

As the mechanism of the present invention has so far been described with reference to one example, the present invention is characterized in that the top roll 1 and the bottom roll 2 of the pinch rolls are crossed with a slight angle $\alpha$. With regard to conventional parallel rolls as described hereinbefore, the pressure applied to a copying paper is in a direction substantially perpendicular to the surface of the paper. However, pressure is exerted not only normally to the paper but also axially to the rolls when the rolls are crossed, according to the present invention. The axial pressure serves to rub the copying paper so that the offset application of the toner to the paper is eliminated. This cross angle $\alpha$ must be selected within a suitable range. As stated previously, when the cross angle is too large, the copying paper may be creased, and when the cross angle is too small, the preventive effect for offset phenomenon is reduced or lost.

The cross angle $\alpha$ should fall within a range from 10′ to 1°30′ in apparatus provided with a 30 mm to 40 mm diameter for the top roll, a 20 mm to 30 mm diameter for the bottom roll of the pair of pinch rolls, and a 30 mm to 40 mm diameter for the backup roll. A cross angle $\alpha$ over 1°30′ may cause wrinkles in the copying paper, while a cross angle under 10′ may reduce the effect of the cross angle for preventing the offset phenomenon of adhering toner to the surface of paper-feeding roll. When the cross angle is selected within this range, suitable compressive and frictional force, due to the cross angle work well between the pinch rolls 1, 2 so that the toner on the passing copying paper may be compressed and may receive torque from the paper to enhance the adhesion of toner to the paper.

The cross angle $\beta$ of the backup roll 3 relative to the top roll 1 also should be limited within a suitable range with respect to the diameter and length of roll.

According to the present invention, the pressure-fixation apparatus may include thrust bearings, besides the needle bearings, for supporting the bottom roll of the pair of pinch rolls. When the driving axle 6 of the top roll 1 rotates in the direction of the circular arrow shown in FIG. 2 by a driving mechanism (not represented), the top roll 1, the bottom roll 2 and the backup roll 3 rotate in respective directions of the arrows as shown in FIG. 3. These rolls are affected by respective thrust forces in the directions of the horizontal arrows of FIG. 2 by the rotations and cross angles of the axes. In regard to the top roll 1 and the backup roll 3, the mechanical strength of the needle bearings 7 and 9 supporting the respective rolls is sufficient to stand the thrust force since their diameters are relatively large. As to the bottom roll 2 of the pinch rolls, a needle bearing 8 alone is insufficient to stand the thrust force since the diameter of the bottom roll is relatively small. Therefore, an end of the bottom roll 2 is preferably provided with a means for receiving the thrust force. FIG. 2 shows an example of an apparatus utilizing both a needle bearing 8 and a thrust bearing 10, but other conventional bearing means for receiving thrust force may also be used.

As described above, the embodiment of the present invention assures a mechanically excellent pressure-fixation apparatus provided with means which prevent the offset phenomenon by placing the top and bottom rolls of the pinch rolls of a three-roll system in a cross position, and means for receiving the thrust load on the bottom roll of the pinch rolls.

EXAMPLE

The top roll of the pinch rolls is a round steel bar of 34 mm in outer diameter and 280 mm in body length. The bottom roll of the pinch rolls is a round steel bar of 22 mm in outer diameter and 280 mm in body length, being disposed in a slight cross position with the top roll. The backup roll which is prepared in accord with the same specification as the top roll, is a round steel bar disposed with a cross angle relative to the bottom roll. These rolls are quenched to obtain a surface hardness of body part more than HRC 60 and then the surfaces are treated with hard chrome plating. The housings are made of cast aluminum alloy of 65 mm in width, 107 mm in height and 12 mm in thickness. The values of cross angles $\alpha$ and $\beta$ under the above conditions are designed to be about 30′ and about 1°30′, respectively. With these structural dimensions, it was recognized that the total pressure necessary to fix toner to ordinary copying paper would be 370 kg (14.5 kg/cm in linear pressure), this pressure being 45% of that which is needed in the conventional apparatus of the "two-roll type". The pressure-fixation apparatus of the example weighs 7 kg, or 45% of the weight of conventional apparatus.

What is claimed is:

1. A device for fixing a dry, pressure-fusible toner image to a carrier sheet by pressure, the device comprising:

A housing member including a pair of vertically oriented side frame members, first and second rolls having different diameters and forming a pair of pinch rolls, said rolls being journaled at both their ends in the side frame members to form a nip through which the carrier sheet, having a dry, pressure-fusible toner image thereon, is passed to fix the toner image to the sheet, means for imparting opposing axially directed forces to said pinch rolls to rub the carrier sheet passing therebetween and to prevent offset images and creases from occurring on the carrier sheet, said means including means for driving one of said pair of pinch rolls by surface contact with the other of said pair and means for positioning said pinch rolls with a skew angle ranging from about 10′ to 1°30′ between the axes of said pinch rolls, said skew angle being measured between the projections of said axes on a horizontal plane, and a third roll resiliently pressing the second roll to the first roll.

2. A device as set forth in claim 1, wherein the first roll has a 30 to 40 mm diameter and the second roll has a 20 to 30 mm diameter.

3. A device as set forth in claim 2, wherein the third roll has a 30 to 40 mm diameter.

4. A device as set forth in claim 1, wherein axis of the third roll is disposed to form an angle with the axis of the second roll.

5. A device as set forth in claim 1, also including means in the side frame members for supporting the second roll for receiving rotatably a thrust load.

6. A device as set forth in claim 1 wherein said first pinch roll is independently driven and said second pinch roll is driven by surface contact with said first pinch roll.

7. A device for fixing a dry, pressure-fusible toner image to a carrier sheet by pressure, the device comprising:

a housing member including a pair of vertically oriented side frame members, said side frame members each having first and second guide members which are moveable upward and downward in the frame members, a first roll journaled at both ends in the side frame members, a second roll having a diameter smaller than that of said first roll and together with said first roll forming a pair of pinch rolls having a nip through which the carrier sheet, having a dry, pressure-fusible toner image thereon, is passed to fix the toner image to the sheet, said second roll being journaled at both ends in respective ones of said first guide members, a third roll having a diameter larger than that of the second roll and being journaled at both ends in respective ones of said second guide members, said third roll for resiliently pressing the second roll against the first roll, said housing also including spring means for exerting a force against said second guide members directed toward said first guide members, means for imparting opposing axially directed forces to said pinch rolls to rub the carrier sheet passing therebetween and to prevent offset images from occurring on the carrier sheet without wrinkling of the carrier sheet, said means including means for driving one of said pair of pinch rolls by surface contact with the other of said pair and means for positioning said second pinch roll with a skew angle ranging from about 10′ to 1°30′ between the axes of said pinch rolls, relative to the first roll, said skew angle being measured between the projections of said axes on a horizontal plane, and means for positioning the third roll with a skew angle relative to the second roll in the direction opposite to the skew direction of the second roll relative to the first roll.

* * * * *